US006378158B1

(12) United States Patent
Bukovitz

(10) Patent No.: US 6,378,158 B1
(45) Date of Patent: Apr. 30, 2002

(54) PAINT ROLLER FRAME AND PLASTIC CAGE ASSEMBLY WITH SLIDING LOCK

(75) Inventor: Richard K. Bukovitz, Orrville, OH (US)

(73) Assignee: The Wooster Brush Company, Wooster, OH (US)

( * ) Notice: Subject to any disclaimer, the term of this patent is extended or adjusted under 35 U.S.C. 154(b) by 0 days.

(21) Appl. No.: 09/707,404

(22) Filed: Nov. 7, 2000

Related U.S. Application Data

(63) Continuation-in-part of application No. 09/338,198, filed on Jun. 22, 1999, now abandoned.

(51) Int. Cl.[7] ..... B05C 1/02
(52) U.S. Cl. ..... 15/230.11; 492/13
(58) Field of Search ..... 15/230, 230.11; 492/13, 17–19

(56) References Cited

U.S. PATENT DOCUMENTS 2,977,671 A 4/1961 Wiegand
3,060,555 A 10/1962 Kirshenbaum et al.
3,447,184 A 6/1969 McGinley
3,751,748 A 8/1973 Roe et al.
3,774,278 A 11/1973 Ashton
3,873,364 A 3/1975 Smith
3,877,123 A 4/1975 Pharris
3,986,226 A 10/1976 Roe et al.
4,237,575 A 12/1980 Mlachnik
4,467,509 A 8/1984 Dezen
5,490,303 A 2/1996 Graves
5,979,009 A 11/1999 Polzin et al.

*Primary Examiner*—Terrence R. Till
(74) *Attorney, Agent, or Firm*—Renner, Otto, Boisselle & Sklar, LLP

(57) ABSTRACT

A paint roller frame and plastic cage assembly, the cage assembly comprising a plurality of circumferentially spaced, axially extending support rails joined together at their ends by inboard and outboard end caps and also intermediate their ends by one or more annular support members. The cage assembly is mounted for limited axial movement in opposite directions on the roller frame shaft, during which cam members on the radial inner walls of radially movable portions of the cage assembly move into and out of engagement with an outer surface of one or more hub assemblies mounted on the shaft. Engagement of the cam members with the hub assemblies causes the radially movable portions to move radially outwardly into frictional engagement with a roller cover when inserted over the cage assembly.

29 Claims, 4 Drawing Sheets

PAINT ROLLER FRAME AND PLASTIC CAGE ASSEMBLY WITH SLIDING LOCK

CROSS-REFERENCE TO RELATED APPLICATIONS

This application is a continuation-in-part of U.S. patent application Ser. No. 09/338,198, filed Jun. 22, 1999 now abandoned.

FIELD OF THE INVENTION

This invention relates generally to a paint roller frame and plastic cage assembly including a sliding lock for securely retaining a roller cover in place on the cage assembly during use while allowing the roller cover to be quickly and easily removed from the cage assembly for ease of cleaning and replacement as desired.

BACKGROUND OF THE INVENTION

It is generally known from U.S. Pat. Nos. 5,345,648 and 5,490,303, assigned to the same assignee as the present application, to provide a plastic cage assembly for a paint roller frame that allows for easy assembly and removal of a roller cover from the cage assembly and yet positively retains the roller cover in place on the cage assembly during use.

However, it would be desirable to provide a plastic cage assembly for a paint roller frame especially for the consumer market that has most of the advantages of such previous known plastic cage assembly but includes fewer, less expensive parts, making it less expensive to manufacture.

SUMMARY OF THE INVENTION

The present invention relates to a paint roller frame and plastic cage assembly of simplified construction that securely retains the roller cover on the cage assembly during use and allows for easy assembly and removal of the roller cover from the cage assembly as needed.

In accordance with one aspect of the invention, the plastic cage assembly includes a plurality of circumferentially spaced, longitudinally extending plastic support rails joined together at their ends by end caps and at a plurality of axially spaced locations intermediate their ends by one or more partitions or walls that also aid in supporting the roller cover when inserted over the cage assembly.

In accordance with another aspect of the invention, the inboard end cap and intermediate partitions or walls have coaxially aligned holes extending therethrough that closely slidably receive the shaft portion of the roller frame for rotatably supporting the cage assembly on the shaft portion.

In accordance with another aspect of the invention, the outboard end of the roller frame shaft is supported by an annular hub assembly axially inwardly of the outboard end cap, whereby the outboard end cap may be completely closed to better prevent paint and the like from getting inside the roller cover through the outboard end cap.

In accordance with another aspect of the invention, the cage assembly is mounted for limited axial movement in opposite directions on the roller frame shaft, which causes cam members on radial inner walls of radially movable portions of the cage assembly to move into and out of engagement with an outer annular surface on the hub assembly, causing the radially movable portions of the cage assembly to move into and out of frictional engagement with the inner wall of a roller cover inserted over the cage assembly.

In accordance with another aspect of the invention, the cam members on the inner walls of the radially movable portions have radially inwardly sloping walls to make it easy for the cam members to ride up and down the annular hub surface, and axial walls at the radial innermost ends of the sloping walls that limit the extent of radial outward movement of the radially movable portions into frictional engagement with the inner wall of the roller cover when the annular hub surface is in contact with the axial walls.

In accordance with another aspect of the invention, radiused shoulders may be provided at the juncture between the sloping walls of the cam surfaces and the associated axial walls to resist axial movement of the cage assembly from a roller cover locking position to a roller cover unlocking position.

In accordance with another aspect of the invention, axially spaced stops on the plastic cage assembly limit the extent of axial movement of the cage assembly in opposite directions relative to the roller frame shaft between the roller cover locking and unlocking positions.

In accordance with another aspect of the invention, the stops are formed by the outboard end cap or stop shoulders on the cam surfaces and the outboard-most partition or wall intermediate the ends of the plastic rails which are respectively engaged by opposite ends of the hub assembly during axial movement of the cage assembly in opposite directions between the roller cover locking and unlocking positions.

In accordance with another aspect of the invention, a roller cover is frictionally retained on the cage assembly after the roller cover has been inserted completely over the cage assembly and up against a radially outwardly extending flange on the inboard-most end of the inboard end cap by pressing on the outboard end cap to cause the cage assembly to move axially inwardly relative to the roller frame shaft which forces the cam surfaces on the radially movable portions of the cage assembly up over the annular hub surface thus causing the radially movable portions to move radially outwardly into frictional engagement with the inner wall of the roller cover.

In accordance with another aspect of the invention, the roller cover is easily released from the cage assembly either by pressing on the inboard end cap or by rapping the handle portion of the roller frame on the edge of a bucket or trash can to cause the cage assembly to move axially outwardly relative to the roller frame shaft to disengage the cam surfaces on the radially movable portions of the cage assembly from the annular hub surface.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE INVENTION

Figure 1:
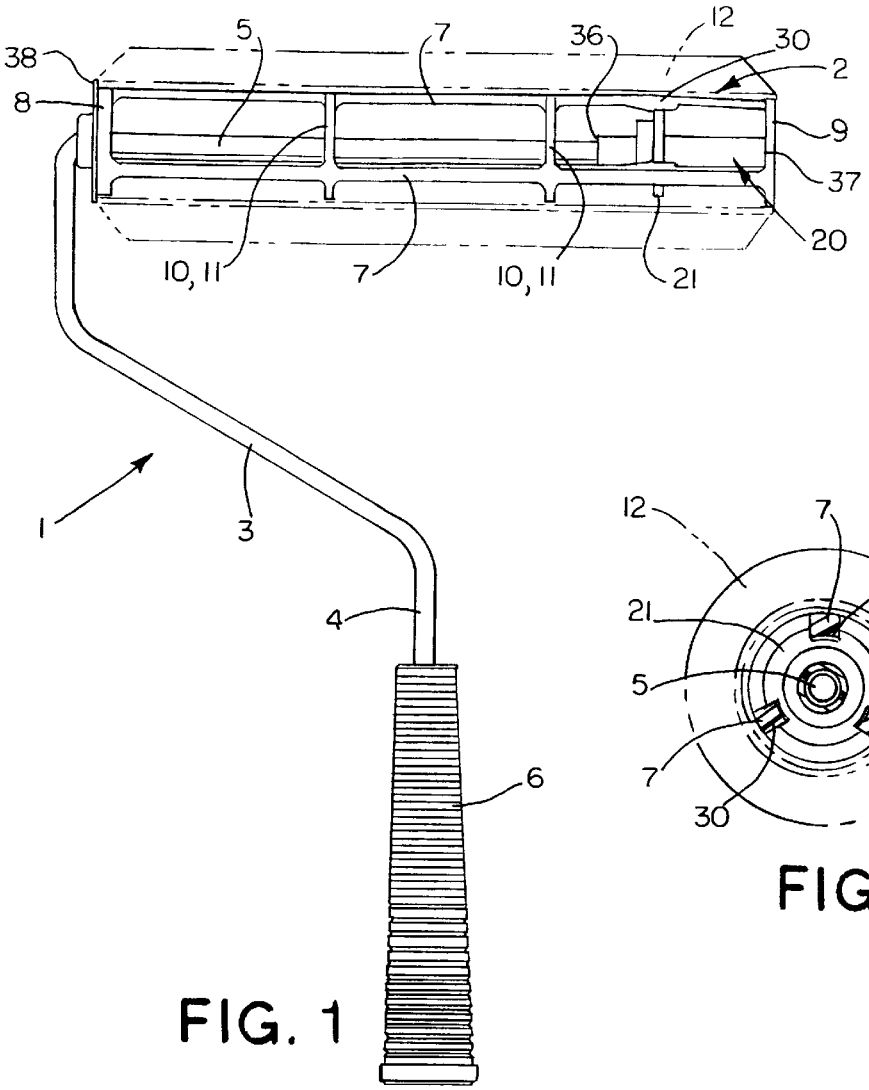
FIG. 1 is a schematic side elevation view of one form of roller frame and cage assembly in accordance with the present invention showing the cage assembly in the fully retracted roller cover locking position.
Figure 3:
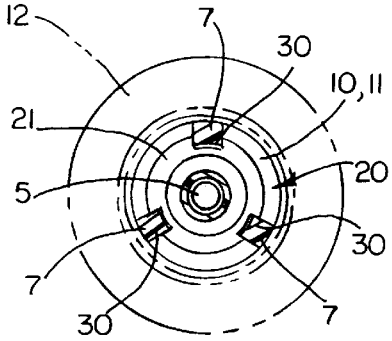
FIG. 3 is a transverse section through the roller frame shaft and cage assembly of FIG. 2, taken generally along the plane of the line 3—3 thereof.
Figure 2:
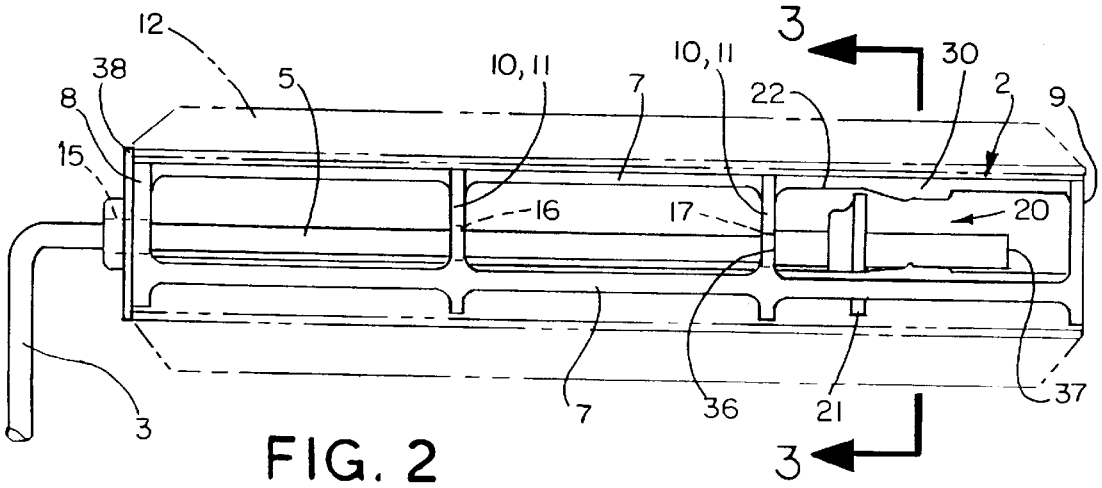
FIG. 2 is an enlarged side elevation view of the roller frame shaft and cage assembly of FIG. 1 but showing the cage assembly in the fully extended roller cover unlocking position.
Figure 4:
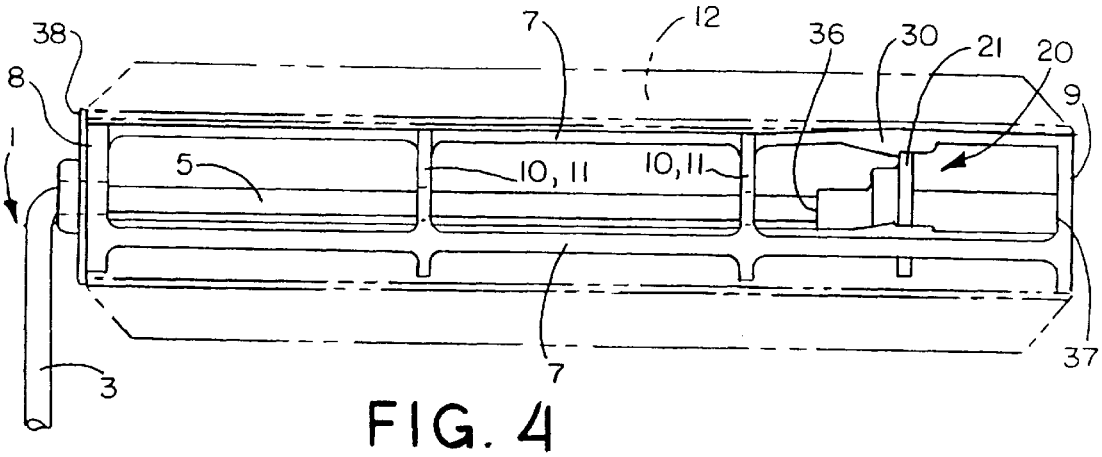
FIG. 4 is an enlarged side elevation view of the roller frame shaft and cage assembly of FIG. 1.

Referring now in detail to the drawings, and initially to FIGS. 1 through 3, there is shown one form of paint roller frame 1 and plastic cage assembly 2 in accordance with this invention. The frame 1 may be made from a heavy gauge wire or rod 3 bent to shape to provide a handle portion 4 at one end and a shaft portion 5 at the other end for rotatably supporting the cage assembly 2 thereon. Attached to the outer end of the handle portion 4 is a hand grip 6 to facilitate grasping of the paint roller frame in one hand. A threaded socket (not shown) may be provided in the outer end of the hand grip 6 for threaded attachment of an extension pole to the frame as desired.

The cage assembly 2 shown in FIGS. 2–6 is preferably molded in one piece out of a suitable plastic material such as acetal or similar thermoplastic material, and includes a plurality of circumferentially spaced, longitudinally extending plastic support rails 7 joined together at their opposite ends by integral end caps 8 and 9 and at one or more axially spaced locations intermediate their ends by one or more integral partitions or walls 10 which give the cage assembly increased strength and rigidity. Preferably, the outer peripheries of the walls 10, like the end caps 8 and 9, blend with the sides of the plastic rails 7 to form axially spaced annular rings 11 each having an outer diameter slightly less than the inner diameter of a paint roller cover 12 (shown in phantom lines in the various figures) to be supported thereby.

Although the cage assembly 2 is shown in FIGS. 1–6 of the drawings as having three support rails 7 each spaced approximately 120° apart, it will be appreciated that the cage assembly may include two or more support rails if desired. Also, where the cage assembly 2 is approximately nine inches long, two intermediate partitions or walls 10 are desirably provided, each located approximately three inches apart and approximately three inches from the adjacent end caps 8, 9. However, it will be appreciated that a greater or lesser number of partitions or walls may be provided as desired.

Extending through the inboard end cap 8 and intermediate partitions or walls 10 are coaxially aligned holes 15, 16 and 17 that closely slidably receive the roller frame shaft 5 for rotatably supporting the cage assembly 2 on the shaft.

Figure 7:
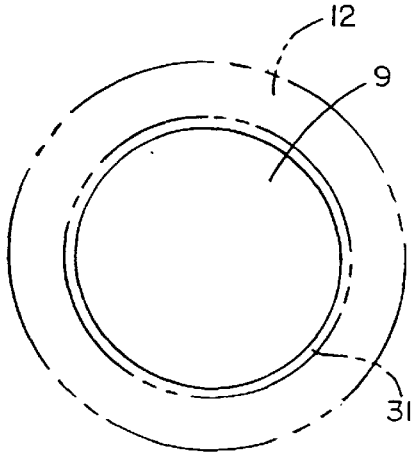
FIG. 7 is an end elevation view of the outboard end cap of the cage assembly as viewed from the right hand end of FIG. 5.
Figure 5:
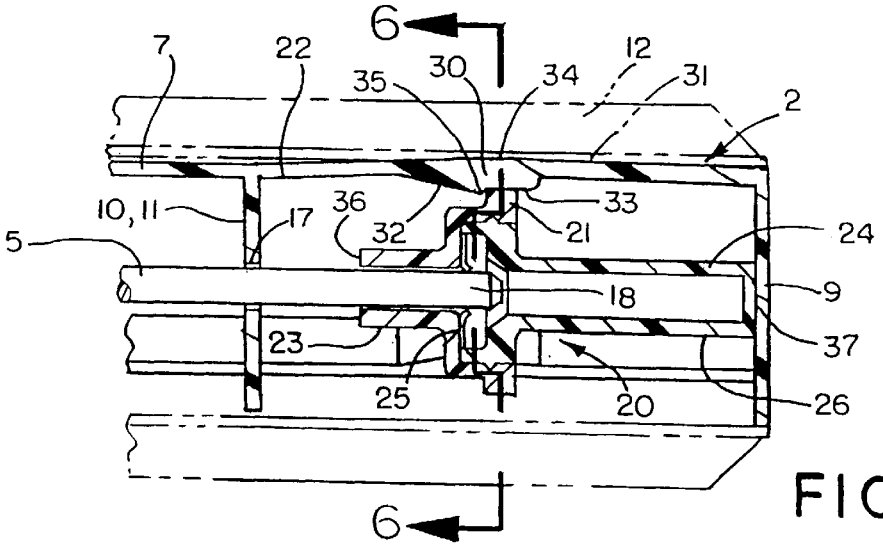
FIG. 5 is a further enlarged fragmentary longitudinal section through the outboard end of the roller frame shaft and cage assembly of FIG. 4.

The length of the roller frame shaft 5 is somewhat less than the length of the cage assembly 2 (see FIG. 5), whereby the outboard end 18 of the roller frame shaft 5 does not extend through the outboard end cap 9. This has the advantage that the outboard end cap 9 may be completely closed as schematically shown in FIGS. 5 and 7 to better resist paint and the like from getting inside the roller cover 12 through the outboard end cap 9.

Figure 6:
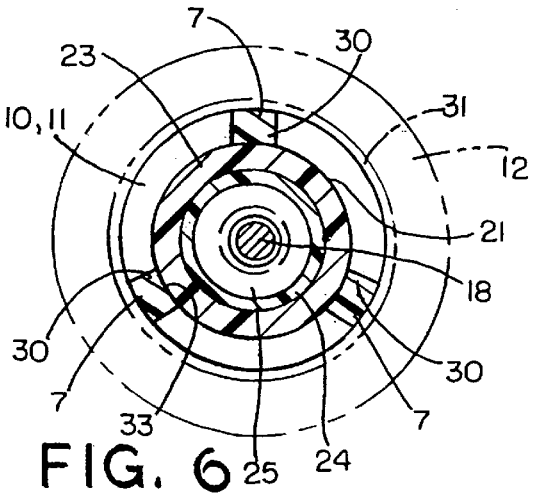
FIG. 6 is a transverse section through the roller frame shaft and cage assembly of FIG. 5, taken generally along the plane of the line 6—6 of FIG. 5.

Attached to the outboard end 18 of the roller frame shaft 5 is an annular hub assembly 20 having an outer annular surface 21 of a radius slightly less than the radius of the radial inner walls 22 of the support rails 7 when in the unstressed condition. The hub assembly 20 includes a female hub member 23 that is slipped over the outboard end of the roller frame shaft 5 and a male hub member 24 that is snapped into the female hub member 23. Fitted within the hub assembly 20 is a self-retaining locking ring 25 that tightly grips the shaft to secure the hub assembly in place on the shaft as schematically shown in FIGS. 5 and 6.

The combined length of the roller frame shaft 5 and outer end portion 26 of the hub assembly 20 protruding axially outwardly beyond the outboard end 18 of the shaft is somewhat less than the length of the cage assembly 2 to permit limited axial movement of the cage assembly in opposite directions on the roller frame shaft. During axial inward movement of the cage assembly 2 relative to the roller frame shaft 5, cam members 30 on the radial inner walls 22 of the support rails 7 intermediate the outboard end cap 9 and adjacent partition or wall 10 ride up over the annular hub surface 21 to cause portions of the support rails to flex or move radially outwardly between the outboard end cap 9 and adjacent partition or wall 10 into frictional contact with the inner wall 31 of a roller cover 12 inserted over the cage assembly as schematically shown in FIGS. 5 and 6. Referring further to FIG. 5, the cam members 30 have radially inwardly sloping walls 32 that allow the cam members to ride up over the annular hub surface 21. At the radial innermost ends of the inwardly sloping walls 32 are axial walls 33 that are engaged by the annular hub surface 21 when the cage assembly is pushed all the way in on the shaft to limit the extent of radial outward flexing of the rails into frictional engagement with the inner wall of the roller cover.

During axial outward movement of the cage assembly 2 relative to the roller frame shaft 5, the cam members 30 on the support rails 7 move axially out of engagement with the annular hub surface 21, thus allowing the previously outwardly flexed rail portions 34 to move radially inwardly to return to their original unstressed condition providing a clearance space with the inner wall of the roller cover as schematically shown in FIGS. 2 and 3. In order for the rails to function in this way, the cage assembly must be made out of a suitable plastic material such as acetal that won't unduly stretch or grow when stressed and has good memory characteristics that allows the rails to return to their original radii when unstressed. A radiused shoulder 35 may be provided at the juncture between the sloping walls 32 of the cam members 30 and the associated axial walls 33 to resist axial movement of the cage assembly 2 from the fully retracted locking position shown in FIGS. 1, 4 and 5 to the fully extended unlocking position shown in FIG. 2.

Axial outward and inward movement of the plastic cage assembly 2 between the two extreme end positions shown in FIGS. 2 and 5 is limited by engagement of opposite ends 36, 37 of the hub assembly 20 with the adjacent partition 10 and outboard end cap 9, respectively.

To assemble the roller cover 12 on the cage assembly 2, the cage assembly 2 must first be in or moved to the fully extended roller cover unlocking position shown in FIG. 2 to permit the roller cover to be easily inserted completely over the cage assembly and up against a radially outwardly extending flange 38 on the inboard-most end of the inboard end cap 8. Next the outboard end cap 9 is pressed axially inwardly to cause the cage assembly 2 to move axially inwardly relative to the roller frame shaft 5. This forces the cam members 30 on the inner walls of the support rails 7 up over the annular hub surface 21, causing the rail portions 34 between the outboard end cap 9 and adjacent partition 10 to flex outwardly into frictional engagement with the inner wall of the roller cover as schematically shown in FIGS. 1 and 4 through 6.

To release the roller cover from the cage assembly, the inboard end cap 8 is either pressed axially outwardly or the handle portion 4 of the wire frame 1 is rapped on the edge of a bucket or trash can to cause the cage assembly 2 to move axially outwardly relative to the roller frame shaft 5 to disengage the cam members 30 on the support rails 7 from the annular hub surface 21 as schematically shown in FIGS. 2 and 3, thus freeing the roller cover from the cage assembly.

FIGS. 8–12 show another form of paint roller frame 1' and plastic cage assembly 2' in accordance with this invention which is similar in many respects to the frame 1 and cage assembly 2 of FIGS. 1–7. Accordingly, the same reference numerals followed by a prime symbol are used to designate like parts.

The cage assembly 2' of the FIGS. 8–12 embodiment differs from the cage assembly 2 shown in the FIGS. 1–7 embodiment in that rather than providing cam members 30 on radial inner walls of the support rails 7, a pair of axially spaced cam members 40 are provided on radial inner walls 41 of radially movable portions or components 42 of the cage assembly 2' which are received in radial slots 43 in the support rails 7'(see FIGS. 9 and 11) for guiding the movable portions or components 42 during such radial movement. During axial inward movement of the cage assembly 2' along the roller frame shaft 5' from the FIG. 8 position to the FIG. 10 position, the cam members 40 on the radial inner walls 41 of the radially movable components 42 ride up over outer hub surfaces 44 of a pair of axially spaced hub assemblies 45 fixedly mounted on the roller frame shaft 5' to cause the radially movable components 42 to move radially outwardly within the rail slots 43 into frictional contact with the inner wall 31 of a roller cover 12 inserted over the cage assembly 2' as shown in phantom lines in FIGS. 8–11.

Figure 10:
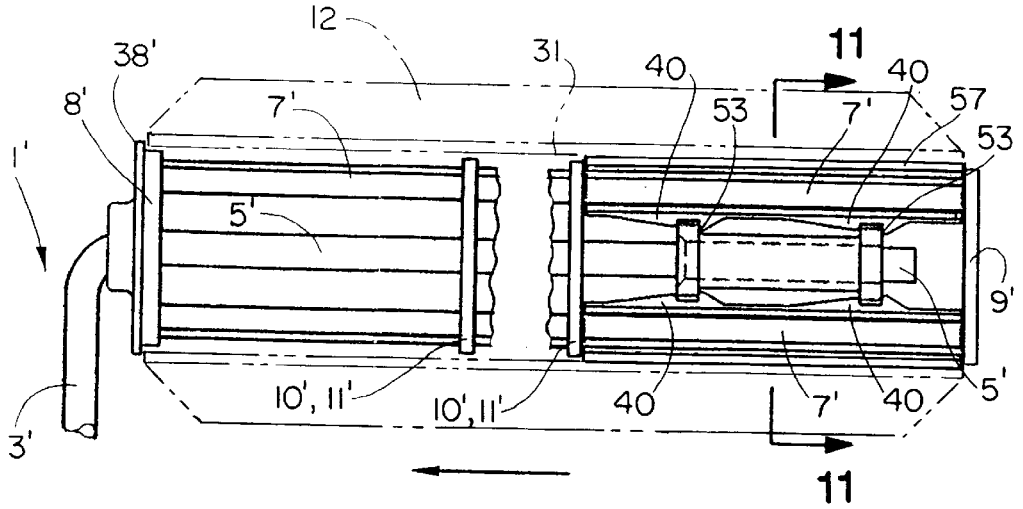
FIG. 10 is a fragmentary side elevation view of the roller frame and cage assembly of FIG. 8 but showing the cage assembly in the roller cover locking position.

Each of the cam members 40 has radially inwardly sloping walls 50 that allow the cam members to ride up over the outer hub surfaces 44 and onto axial walls 51 of the cam members that are engaged by the outer hub surfaces 44 when the cage assembly 2' is pushed all the way in on the shaft 5' as schematically shown in FIG. 10 to limit the extent of radial outward movement of the radially movable components 42 into frictional engagement with the inner wall of the roller cover.

Figure 8:
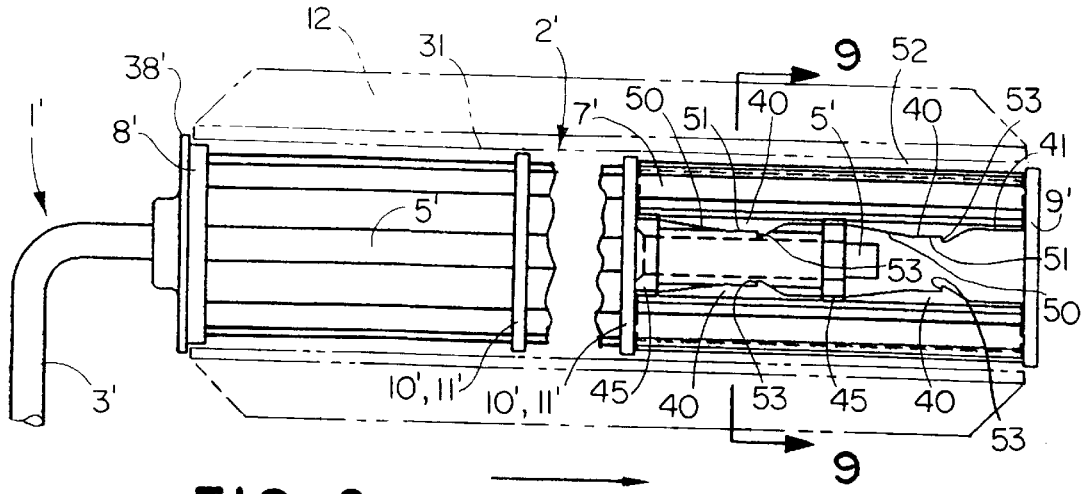
FIG. 8 is an enlarged fragmentary side elevation view of another form of roller frame and cage assembly in accordance with the present invention showing the cage assembly in the roller cover unlocking position.
Figure 9:
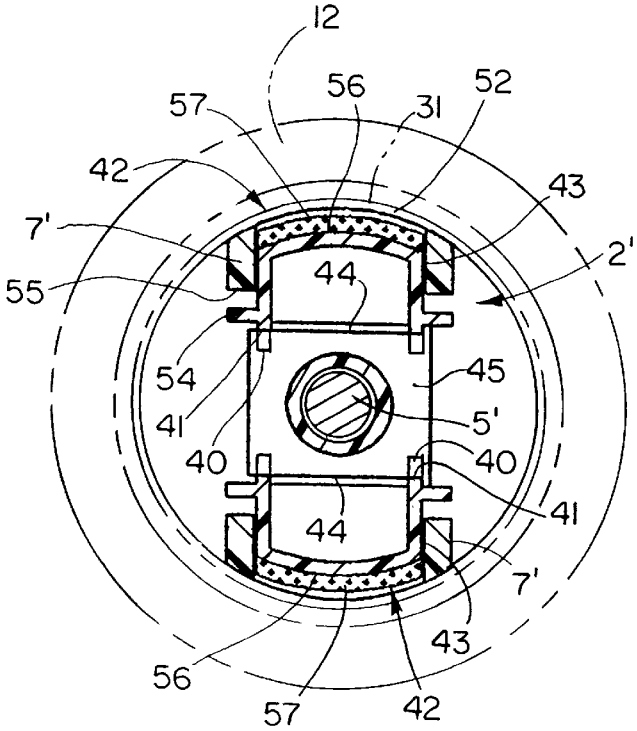
FIGS. 9 and 11 are further enlarged transverse sections through the roller frame shaft and cage assembly of FIGS. 8 and 10, respectively, taken generally along the respective planes of the lines 9—9 and 11—11 thereof.

During axial outward movement of the cage assembly 2' along the roller frame shaft 5' (from the FIG. 10 position to the FIG. 8 position), the cam members 40 on the radially movable components 42 move axially out of engagement with the outer hub surfaces 44, thus allowing the radially movable components 42 to move radially inwardly within the respective slots 43 in the support rails 7' to provide a clearance space 52 between the radially movable components 42 and the inner wall 31 of the roller cover 12 as schematically shown in FIGS. 8 and 9 for ease of insertion and removal of the roller cover on and from the cage assembly.

Axial movement of the plastic cage assembly 2' between the two extreme end positions shown in FIGS. 8 and 10 is limited by engagement of the axial innermost hub assembly 45 with the adjacent partition 10' of the cage assembly 2' (when moved to the axial outermost position shown in FIG. 8) and engagement of the hub assemblies 45 with radial shoulders 53 at the axial outermost ends of the cam members 40 (when moved to the axial innermost position shown in FIG. 10).

The radially movable components 42 are retained within the radial slots 43 in the support rails 7' by transverse flanges 54 on the radially movable components 42 underlying the radial inner walls 55 of the rails. (See FIGS. 9 and 11.) The radial outer walls 56 of the radially movable components 42 are transversely rounded, with a radius substantially corresponding to the radius of the outer peripheries of the partitions 10', end caps 8' and 9', and plastic rails 7' to help support a paint roller cover 12 when inserted over the plastic cage assembly 2'. Also, compressible material 57 may be overmolded onto the radial outer walls 56 of the 30 radially movable components 42 (see FIGS. 9, 11 and 12), whereby when the radially movable components are moved radially outwardly, the compressible material 57 will compress against the inner wall of the paint roller cover creating additional friction preventing movement of the paint roller cover relative to the cage assembly when the cage assembly is in the locked position shown in FIGS. 10 and 11.

Figure 11:
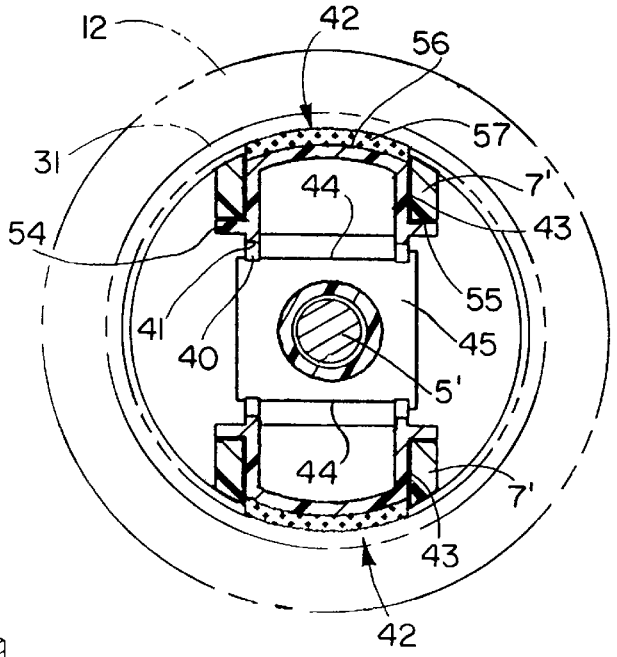
Figure 12:
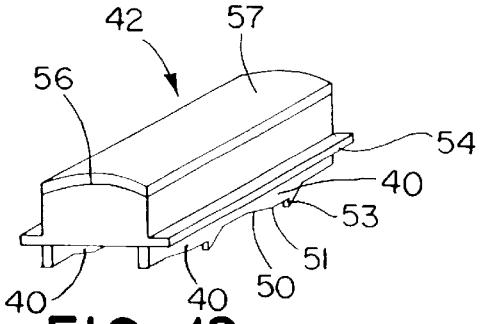
FIG. 12 is an enlarged perspective view of one of the radially movable portions of the roller frame and cage assembly embodiment of FIGS. 8–11.

To insert the roller cover 12 on the cage assembly 2', the cage assembly 2' must first be in or moved to the fully extended roller cover unlocking position shown in FIGS. 8 and 9 to permit the roller cover to be easily inserted onto the cage assembly and up against the radially outwardly extending flange 38' on the inboard-most end of the inboard end cap 8'. Next the outboard end cap 9' is pressed axially inwardly to cause the cage assembly 2' to move axially inwardly along the roller frame shaft 5' (from the FIG. 8 position to the FIG. 10 position), forcing the cam members 40 on the radial inner walls 41 of the radially movable components 42 up over the outer hub surfaces 44. This causes the radially movable components 42 to move radially outwardly into frictional engagement with the inner wall 31 of the roller cover 12 as schematically shown in FIGS. 10 and 11.

To release the roller cover 12 from the cage assembly 2', the inboard end cap 8' is either pressed axially outwardly or the handle portion of the wire frame 1' is wrapped on the edge of a bucket or trash can or the like to cause the cage assembly 2' to move axially outwardly relative to the roller frame shaft 5' to disengage the cam members 40 on the radially movable components 42 from the outer hub surfaces 44 as schematically shown in FIGS. 8 and 9, thus freeing the roller cover from the cage assembly.

Although the invention has been shown and described with respect to certain embodiments, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein illustrated exemplary embodiments of the invention. In addition, while a particular feature of the invention may have been disclosed with respect to only one embodiment, such feature may be combined with one or more other features of other embodiments as may be desired and advantageous for any given or particular application.

What is claimed is:

1. A paint roller frame and plastic cage assembly, said frame comprising a handle portion and a shaft portion, said cage assembly being mounted on said shaft portion for rotation and for limited axial movement in opposite directions relative to said shaft portion, said cage assembly comprising a plurality of circumferentially spaced, axially extending support rails joined together by a plurality of axially spaced annular support members, cam members on radial inner walls of a plurality of said support rails intermediate two of said annular support members, and a hub member mounted on said shaft portion, said cam members being movable into and out of engagement with said hub member during such limited axial movement of said cage assembly in opposite directions relative to said shaft portion to cause portions of said support rails to flex radially into and out of frictional engagement with an inner wall of a roller cover when inserted over said cage assembly.

2. The frame and cage assembly of claim 1 wherein said cage assembly is axially movable relative to said shaft portion between a fully extended position in which said cam members are disengaged from said hub member and a fully retracted position in which said cam members are engaged with said hub member.

3. The frame and cage assembly of claim 2 wherein said cam members have radially inwardly sloping walls that allow said cam members to easily ride up and down said hub member during such axial movement of said cage assembly between the retracted and extended positions.

4. The frame and cage assembly of claim 3 wherein said cam members have axial walls at radial innermost ends of said sloping walls that limit the extent of radial outward flexing of said rail portions when said cage assembly is in the retracted position.

5. The frame and cage assembly of claim 4 wherein said cam members have radiused shoulders at a juncture between said sloping walls and said axial walls that resist axial movement of said cage assembly from the retracted position to the extended position.

6. The frame and cage assembly of claim 1 wherein one of said annular support members comprises an outboard end cap at an outboard end of said cage assembly, said shaft portion having an outboard end that terminates inboard of said outboard end cap, said outboard end cap being completely closed to better resist paint and the like from getting inside a roller cover inserted over said cage assembly at said outboard end cap.

7. The frame and cage assembly of claim 1 wherein one of said annular support members comprises an outboard end cap at an outboard end of said cage assembly, another of said annular support members comprises an inboard end cap at an inboard end of said cage assembly, and all of said annular support members except for said outboard end cap have coaxially aligned holes that closely slidably receive said shaft portion for rotatably supporting said cage assembly on said shaft portion.

8. The frame and cage assembly of claim 1 wherein said hub member is mounted on said shaft portion between two of said annular support members, said hub member having opposite ends engageable with one or the other of said two annular support members during axial movement of said cage assembly in opposite directions relative to said shaft portion to limit such axial movement between one extreme end position in which said cam members are disengaged from said hub member and an other extreme end position in which said cam members are fully engaged with said hub member.

9. The frame and cage assembly of claim 8 wherein said hub member comprises male and female members that are snapped together when inserted over an outboard end of said shaft portion, and a self-retaining locking ring inside said hub member tightly grips said shaft portion to secure said hub member in place on said shaft portion.

10. The frame and cage assembly of claim 1 wherein one of said annular support members comprises an outboard end cap at an outboard end of said cage assembly, and another of said annular support members comprises an inboard end cap at an inboard end of said cage assembly, said inboard and outboard end caps having an outer radius slightly less than an inner radius of a roller cover to be supported by said cage assembly.

11. The frame and cage assembly of claim 10 wherein said inboard end cap has a radially outwardly extending flange at an inboard most end that acts as a stop to locate a roller cover inserted over said cage assembly.

12. The frame and cage assembly of claim 10 wherein said support rails have an outer radius slightly less than the inner radius of a roller cover to be supported by said cage assembly.

13. The frame and cage assembly of claim 12 wherein said support rails have an inner radius adjacent said cam members that is slightly greater than an outer radius of said hub member whereby when said cage assembly is moved to disengage said cam members from said hub member, said rail portions will return to their original unflexed condition.

14. A paint roller frame and cage assembly, said frame comprising a handle portion and a shaft portion, said cage assembly being mounted for rotation and for limited axial movement in opposite directions relative to said shaft portion, said cage assembly comprising a plurality of circumferentially spaced, axially extending support rails joined together intermediate their ends by one or more axially spaced annular support members and by inboard and outboard end caps at opposite ends of said support rails, cam members on radial inner walls of said support rails intermediate said outboard end cap and an adjacent annular support member, and a hub member mounted on said shaft portion, said cam members being movable into and out of engagement with an annular hub surface on said hub member during such limited axial movement of said cage assembly in opposite directions relative to said shaft portion to cause portions of said support rails between said outboard end cap and said adjacent annular support member to flex radially outwardly and inwardly.

15. The frame and cage assembly of claim 14 wherein said shaft portion includes an outboard end that terminates axially inwardly of said outboard end cap, said outboard end cap being completely closed to better resist paint and the like from getting inside a roller cover around said outboard end cap when the roller cover is inserted over said cage assembly.

16. A paint roller frame and plastic cage assembly, said frame comprising a handle portion and a shaft portion, said cage assembly being mounted on said shaft portion for rotation and for limited axial movement in opposite directions relative to said shaft portion, said cage assembly comprising a plurality of circumferentially spaced, axially extending support rails joined together by a plurality of axially spaced annular support members, radially movable portions, cam members on said radially movable portions, and at least one hub member mounted on said shaft portion, said cam members being movable into and out of engagement with said hub member during such limited axial movement of such cage assembly in opposite directions relative to said shaft portion, said cam members when moved into engagement with said hub member causing said radially movable portions to move radially outwardly into frictional engagement with an inner wall of a roller cover when inserted over said cage assembly.

17. The frame and cage assembly of claim 16 wherein said radially movable portions comprise portions of a plurality of said support rails, said cam members when moved into and out of engagement with said hub member causing said portions of said support rails to flex radially into and out of frictional engagement with the inner wall of a roller cover when inserted over the cage assembly.

18. The frame and cage assembly of claim 16 wherein said radially movable portions comprise radially movable components received in radial slots in a plurality of said support rails for guiding said components during such radial movement.

19. The frame and cage assembly of claim 18 wherein each of said radially movable components has a plurality of cam members on radial inner walls of said components, and two axially spaced hub members are mounted on said shaft portion, said cam members being movable into and out of engagement with said hub members during such limited axial movement of such cage assembly in opposite directions relative to said shaft portion.

20. The frame and cage assembly of claim 18 wherein said components have radially outer walls that are transversely rounded.

21. The frame and cage assembly of claim 20 further comprising a compressible material on said radially outer walls of said components which is compressed against the inner wall of a roller cover when inserted over the cage assembly and the cam members are moved into engagement with the hub member causing the components to move radially outwardly into frictional engagement with such inner wall.

22. The frame and cage assembly of claim 18 wherein said cage assembly is axially movable relative to said shaft portion between a fully extended position in which said cam members are disengaged from said hub member and a fully retracted position in which said cam members are engaged with said hub member.

23. The frame and cage assembly of claim 22 wherein said cam members have radially inwardly sloping walls that allow said cam members to easily ride up and down said hub member during such axial movement of said cage assembly between the retracted and extended positions.

24. The frame and cage assembly of claim 23 wherein said cam members have axial walls at radial innermost ends of said sloping walls that limit the extent of radial outward movement of said radially movable portions when said cage assembly is in the retracted position.

25. The frame and cage assembly of claim 24 wherein said cam members have radial shoulders at axial outermost ends of said cam members that are engageable with said hub member during axial inward movement of said cage assembly relative to said shaft portion to limit such axial inward movement of said cage assembly.

26. The frame and cage assembly of claim 18 wherein one of said annular support members comprises an outboard end cap at an outboard end of said cage assembly, said shaft portion having an outboard end that terminates inboard of said outboard end cap, said outboard end cap being completely closed to better resist paint and the like from getting inside a roller cover inserted over said cage assembly at said outboard end cap.

27. The frame and cage assembly of claim 18 wherein said hub member is engageable with one of said annular support members during axial outward movement of said cage assembly relative to said shaft portion to limit such axial outward movement of said cage assembly.

28. The frame and cage assembly of claim 18 wherein one of said annular support members comprises an outboard end cap at an outboard end of said cage assembly and another of said annular support members comprises an inboard end cap at an inboard end of said cage assembly, said inboard and outboard end caps having an outer radius slightly less than an inner radius of a roller cover to be supported by said cage assembly.

29. The frame and cage assembly of claim 28 wherein said inboard end cap has a radially outwardly extending flange at an inboard-most end that acts as a stop to locate a roller cover inserted over said cage assembly.

* * * * *